United States Patent [19]

Foley

[11] Patent Number: 5,007,637

[45] Date of Patent: Apr. 16, 1991

[54] SELECTIVELY MOUNTABLE BASKETBALL HOOP STRUCTURE

[75] Inventor: Charles F. Foley, Charlotte, N.C.

[73] Assignee: InnoLand, Inc., Pineville, N.C.

[21] Appl. No.: 394,640

[22] Filed: Aug. 16, 1989

[51] Int. Cl.[5] ..... A63B 63/08; A63B 63/04

[52] U.S. Cl. ..... 273/1.5 R; 248/207

[58] Field of Search ..... 273/1.5 R, 1.5 A; 248/207, 231.2, 224.3

[56] References Cited

U.S. PATENT DOCUMENTS

| | | | |
|---|---|---|---|
| 417,997 | 12/1889 | Dupuis | 248/207 X |
| 1,245,744 | 11/1917 | Leibner | 248/207 |
| 1,522,957 | 1/1925 | Kennedy | 273/1.5 R |
| 2,512,417 | 6/1950 | Cook | 273/1.5 R X |
| 4,241,916 | 12/1980 | Palm | 273/1.5 R |
| 4,657,249 | 4/1987 | Offutt | 273/1.5 R |
| 4,793,611 | 12/1988 | Thornell | 273/1.5 R |
| 4,887,812 | 12/1989 | Moormann | 273/1.5 R |

FOREIGN PATENT DOCUMENTS

| | | | |
|---|---|---|---|
| 366016 | 1/1932 | United Kingdom | 248/207 |

*Primary Examiner*—Paul E. Shapiro

*Attorney, Agent, or Firm*—Shefte, Pinckney & Sawyer

[57] ABSTRACT

A basketball hoop structure includes a small scale basketball hoop member securable to a door or other structure by a bracket. The bracket is of a generally U-shape for selective alternative receipt of a horizontal and vertical edge of the door. Additionally, the bracket includes an arrangement for mounting the small scale basketball hoop member in either a selected horizontal or vertical orientation relative thereto both when the bracket is mounted on a horizontal door edge and when the bracket is mounted on a vertical door edge.

13 Claims, 6 Drawing Sheets

SELECTIVELY MOUNTABLE BASKETBALL HOOP STRUCTURE

BACKGROUND OF THE INVENTION

The present invention relates to a basketball hoop structure adapted for selective mounting to a door or similar structural building member as an amusement device for playing a basketball game.

In recent years, small scale versions of a basketball hoop and net assembly have become popular indoor amusement devices presenting a target through which a small scale basketball or like object can be tossed, thereby simulating the playing of basketball.

Several relatively dissimilar structures for supporting small scale basketball hoop and net assemblies are commercially available. For example, one commercially available structure includes a pole supported vertically by a stand and having a small scale basketball hoop mounted to a backboard secured to the pole at a spacing above the stand. This type of structure typically is capable of supporting the small scale basketball hoop at differing selected elevations above the floor and likewise can be moved to various positions around the floor. Another type of commercially available small scale basketball hoop and support structure provides a hoop having suction cups mounted to opposite rearward sides of the hoop. The suction cups are adapted to mount the hoop to a flat surface which the cups can engage by suction action. Yet another commercially available type of small scale basketball hoop and support is a hoop connected to a bracket which is adapted to be mounted over the top of a building structure such as the top of a door, without interference to the closing of said door.

As can be appreciated, each of the above-mentioned commercially available small scale basketball hoop and support assemblies suffer from several specific and general disadvantages. For example, the stand of the pole support structure requires a commensurate amount of floor space which limits appeal of the structure. The suction cup assembly suffers from the drawback inherent to such suction cup-type mounting assemblies in that only certain non-porous surfaces will cooperate with the suction cups and the suction action may not be reliably maintained due to, for example, temperature changes. The bracket type assembly has inherent limitations with respect to varying the vertical spacing of the small scale basketball hoop from the floor since the bracket must necessarily be mounted on top of the support structure, such as a door, to maintain the basketball hoop in a horizontal position, thereby eliminating its usage by vast number of young potential users.

SUMMARY OF THE INVENTION

The present invention provides a selectively mountable hoop structure for use in playing a basketball game, the hoop structure including a hoop member defining an opening adapted for passage therethrough of a ball, the hoop member including a mounting portion, and a bracket for selective mounting of the hoop member. The bracket is of a generally U-shaped for selective alternative receipt of an exposed edge of a building door and like structural members of buildings and the bracket has means compatible with the mounting portion of the hoop member for receiving the mounting portion selectively in alternative first and second orientations relative to the bracket for selectively altering the relative verticality and horizontality of the hoop member. For example, the mounting portion receiving means of the bracket may include a first slideway for insertion therein of the mounting portion of the hoop member in the first orientation and a second slideway for insertion of the mounting portion of the hoop member in the second orientation, the slideways preferably being generally arranged perpendicular to one another. In one embodiment of the hoop structure, the mounting portion receiving means includes a pair of spaced tabs projecting from the bracket and defining therebetween the first slideway, the tabs having respectively aligned openings therethrough defining the second slideway. In another embodiment, the mounting portion receiving means includes a coupling portion having first and second pairs of aligned openings respectively defining the first and second slideways.

In a further embodiment of the present hoop structure, the mounting portion receiving means defines a slideway for receiving the mounting portion of the hoop member which is of a symmetrical configuration for selective alternative insertion in the slideway in the first and second orientations to accommodate the various thicknesses of a building door and like structural members of buildings. Preferably, the mounting portion of the hoop member includes a plurality of spaced mounting elements for alternative insertion in the slideway for varying the relative disposition of the hoop member toward and away from the structural building member, permitting the mounting portion to be abutted with the structural building member for frictionally retaining the bracket and hoop member thereon.

According to another aspect of the present invention, the bracket includes first and second leg members in spaced facing relation and a cross member extending transversely therebetween, the leg members being biased toward one another for resiliently gripping the structural building member to retain the bracket thereon.

The hoop member can include a plurality of fastener elements spaced thereabout for supporting a net on the hoop member. Preferably, each fastener element includes a cleat for crossing thereabout of a loop of the net.

DETAILED DESCRIPTION OF THE PREFERRED EMBODIMENTS

Figure 1:
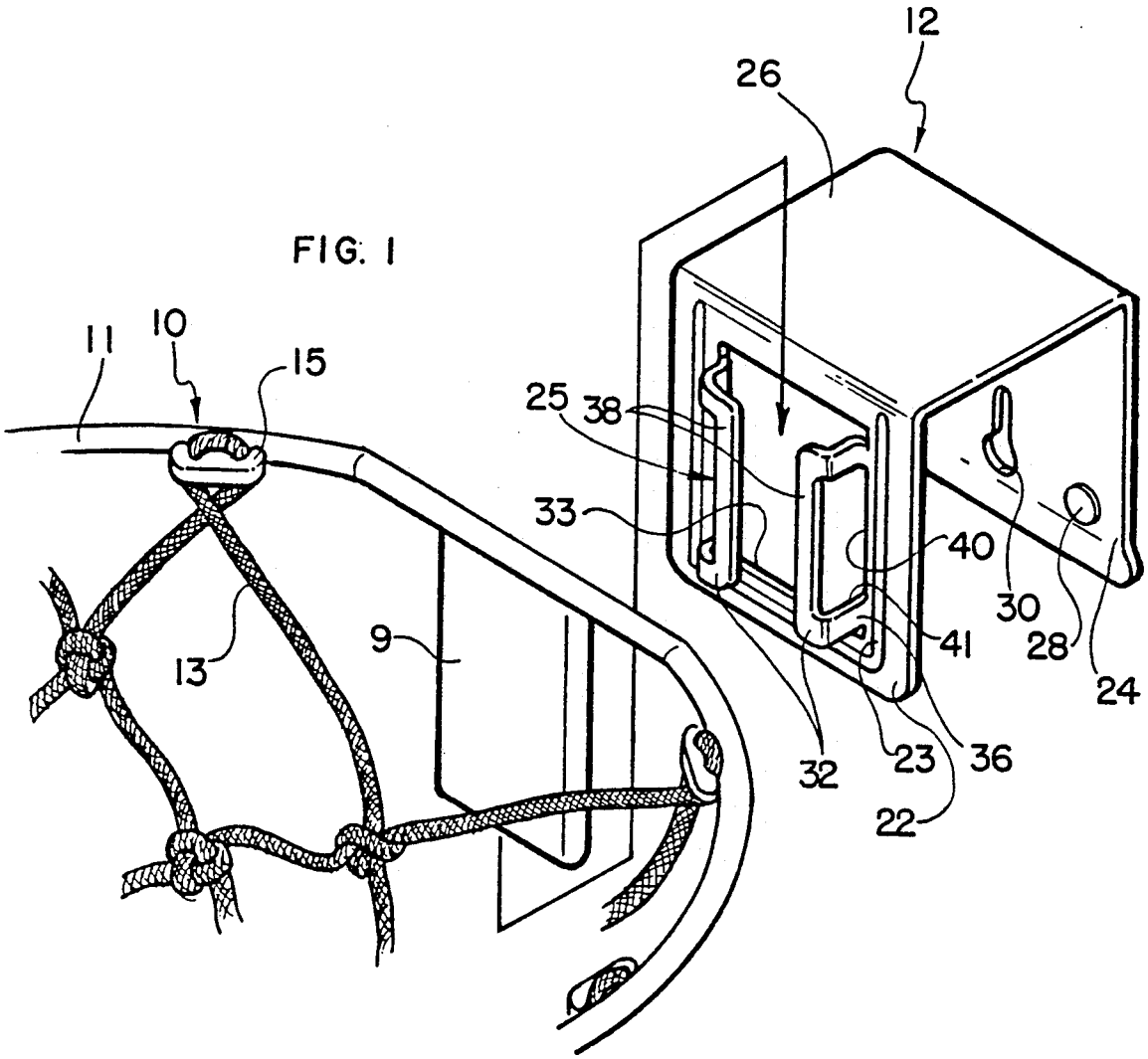
FIG. 1 is a perspective view of one preferred embodiment of the basketball hoop structure of the present invention.
Figure 2:
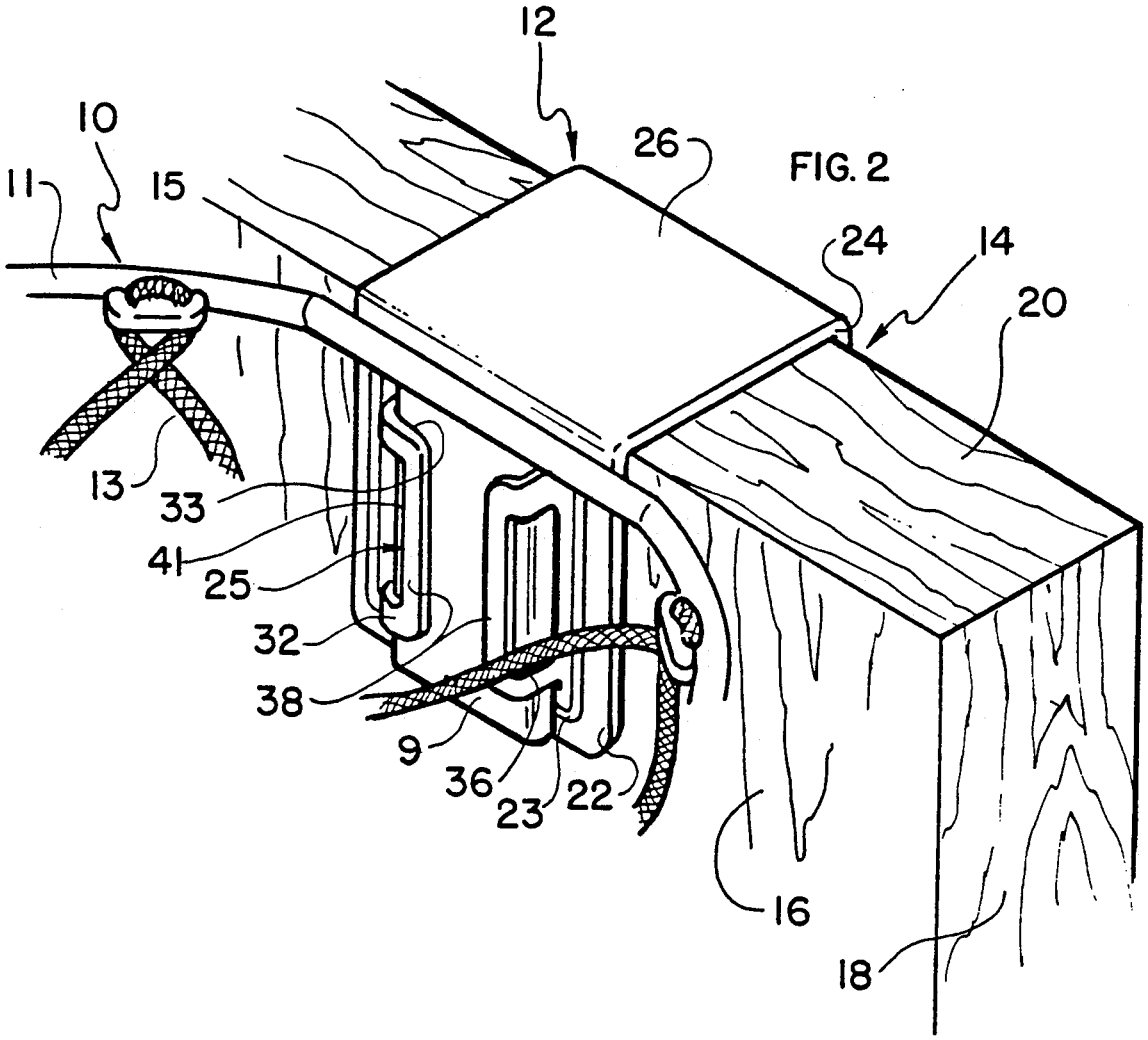
FIG. 2 is a perspective view of the basketball hoop structure of FIG. 1, shown mounted on the top horizontal edge of a door.

In FIGS. 1-3, one preferred embodiment of the basketball hoop structure of the present invention is illustrated and basically includes a small scale basketball hoop member, generally designated as 10, and a bracket, generally designated as 12, for securing the hoop member 10 to a structure commonly found in a building, such as a door 14, to support the hoop member 10 above a floor or like surface. When the hoop member 10 is so supported, a user can toss an object such as a corresponding small scale basketball through a hoop portion 11 of the hoop member 10 and thereby simulate the playing of a game of basketball or play other similar basketball-type games.

The hoop member 10 includes the hoop portion 11, which is of generally circular configuration defining a central opening sufficient for passage therethrough of a small scale basketball or like ball (not shown), and a mounting portion 9 integrally formed with and extending essentially perpendicularly from the hoop portion 11. A plurality of loops of a net 13 are each crossed about a respective one of a plurality of regularly spaced cleats 15 on the hoop portion 11, thereby securing the net 13 to the hoop portion 11.

The door 14 is of the typical construction including a pair of relatively large, oppositely facing rectangular surfaces 16 spaced from one another by a bottom surface (not shown), a pair of vertical side surfaces 18 and a horizontal top surface 20.

The bracket 12 is of a substantially U-shape including first and second leg members 22, 24 and a cross member 26 extending transversely between respective side edges of the leg members 22, 24 for interconnecting the leg members 22, 24 in spaced facing relationship. Each of the leg and cross members 22, 24, 26 is of a rectangular, substantially flat, plate-like construction, the inwardly facing surfaces of the leg members 22, 24 being adapted for engaging respectively the rectangular surfaces 16 of the door 14 and the inwardly facing surface of the cross member 26 being likewise adapted for engaging a side or top surface 18, 20 of the door 14. As best shown in FIG. 1, the leg member 24 has a pair of cylindrical rubber foot pads 28 (only one of which is shown) for contacting the door 14 to thereby space the leg member 24 slightly from the door surface so that detrimental marring, scratching or scuffing of the door surface by the leg member 24 is prevented.

The leg member 22 is provided with a generally U-shaped rib 23 extending inwardly from the door facing surface of the leg member. The U-shaped rib 23 can be formed, for example, by stamping a U-shaped channel on the opposite surface of the leg member 22 such that the leg member material displaced by the stamping of the U-shaped channel forms the U-shaped rib 23. The U-shaped rib 23 contacts the surface of the door 14 to slightly space the remainder of the door facing surface of the leg member 22 from the door surface to prevent detrimental marring, scratching or scuffing of the door surface.

The leg members 22, 24 and the cross member 26 are preferably formed as an integral unit with the cross member 26 generally perpendicular to each respective leg member 22, 24. Preferably, the connection between each of the leg members 22, 24 and the cross member 26 is such that each leg member is resiliently biased toward the other. For example, the bracket 12 may be formed from a length of spring steel having its end portions appropriately bent to form the two leg members 22, 24 and to define therebetween the cross member 26. Alternatively, the bracket 12 may be molded of a resilient plastic material. The leg member 24 may include a pair of keyways 30 for receiving bolts or screws (not shown) therethrough to fixedly secure the bracket 12 to the door 14 or to another building surface or structure, such as a vertical wall.

The bracket 12 is additionally provided with a hoop mounting portion receiving means, generally indicated at 25, for selective mounting of the hoop member 10 on the bracket 12, the hoop mounting portion receiving means basically including a pair of tabs 32 integrally formed on the leg member 22 at a lateral spacing from one another. Each tab 32 includes a pair of spaced legs 36 integrally formed with and extending generally perpendicularly outwardly from the leg member 22 and a retaining bar 38 interconnecting the outward ends of the legs 36 in generally parallel relation to the leg member 22. The leg member 22, the legs 36 and the retaining bar 38 of each tab 32 define a generally rectangular opening 40, the two openings 40 being aligned laterally with one another. The respective retaining bars 38 of the tabs 32 extend toward one another in generally coplanar relation. The retaining bars 38 are spaced outwardly from the first leg member 22 by a dimension about the same as or slightly larger than the thickness of the hoop mounting portion 9. Additionally, the legs 36 of each respective tab 32 are generally parallel to the respective opposite legs of the other tab 32 and these respective opposed legs of the tabs 32 define an extent therebetween about the same as or slightly greater than the widthwise extent of the mounting portion 9. Likewise, the longitudinal extent of each opening 40, as measured between the legs 36 defining two opposite sides thereof, is about the same as or slightly greater than the widthwise extent of the mounting portion 9 and the transverse extent of each opening 40, as measured between the leg member 22 and the retaining bar 38, is about the same as or slightly greater than the thickness of the mounting portion 9.

As can thus be understood, the tabs 32 define a first slideway 33 therebetween for receiving the mounting portion 9 inserted therein, the legs 36 preventing lateral movement of the mounting portion 9 while the retaining bars 38 cooperate with the outwardly facing surface of the first lateral portion 22 to prevent movement of the mounting portion 9 toward or away from the door. (See FIG. 2). On the other hand, the aligned openings 40 define a second slideway 41 therethrough for receiving the mounting portion 9, essentially perpendicular to the first slideway between the tabs 32, the retaining bars 38 preventing the mounting portion 9 from movement in a direction away from the door 14 while the leg member 22 prevents the mounting portion 9 from movement in a direction toward the door 14 and the bars 38 of the tabs 32 preventing movement of the mounting portion 9 in a direction parallel to the rectangular surfaces 16 (see FIGS. 3A and 3B).

Figure 3A:
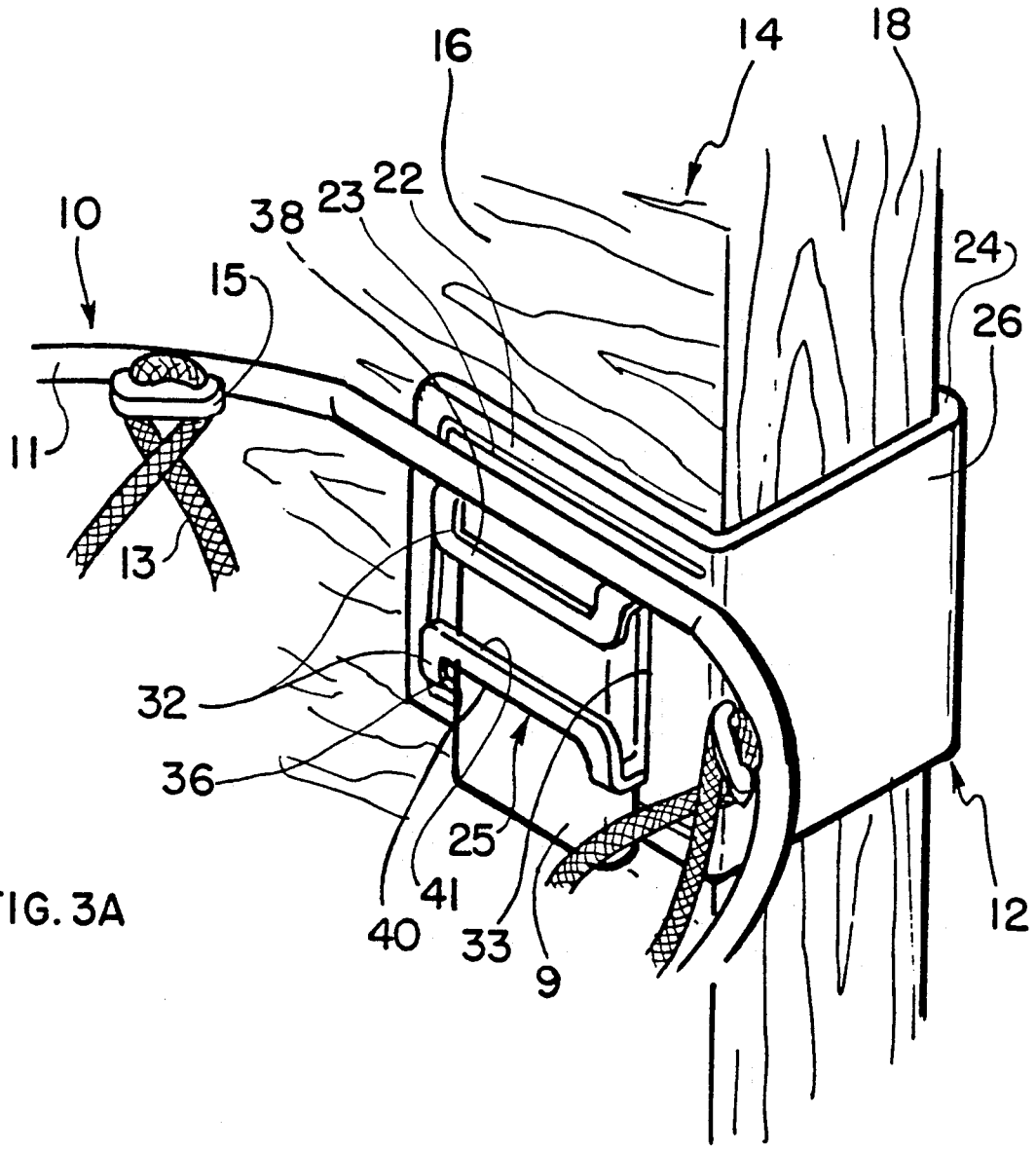
FIG. 3A is a perspective view of the basketball hoop structure of FIG. 1, showing the bracket mounted to a door along a vertical side edge thereof and the hoop portion supported horizontally by the bracket.
Figure 3B:
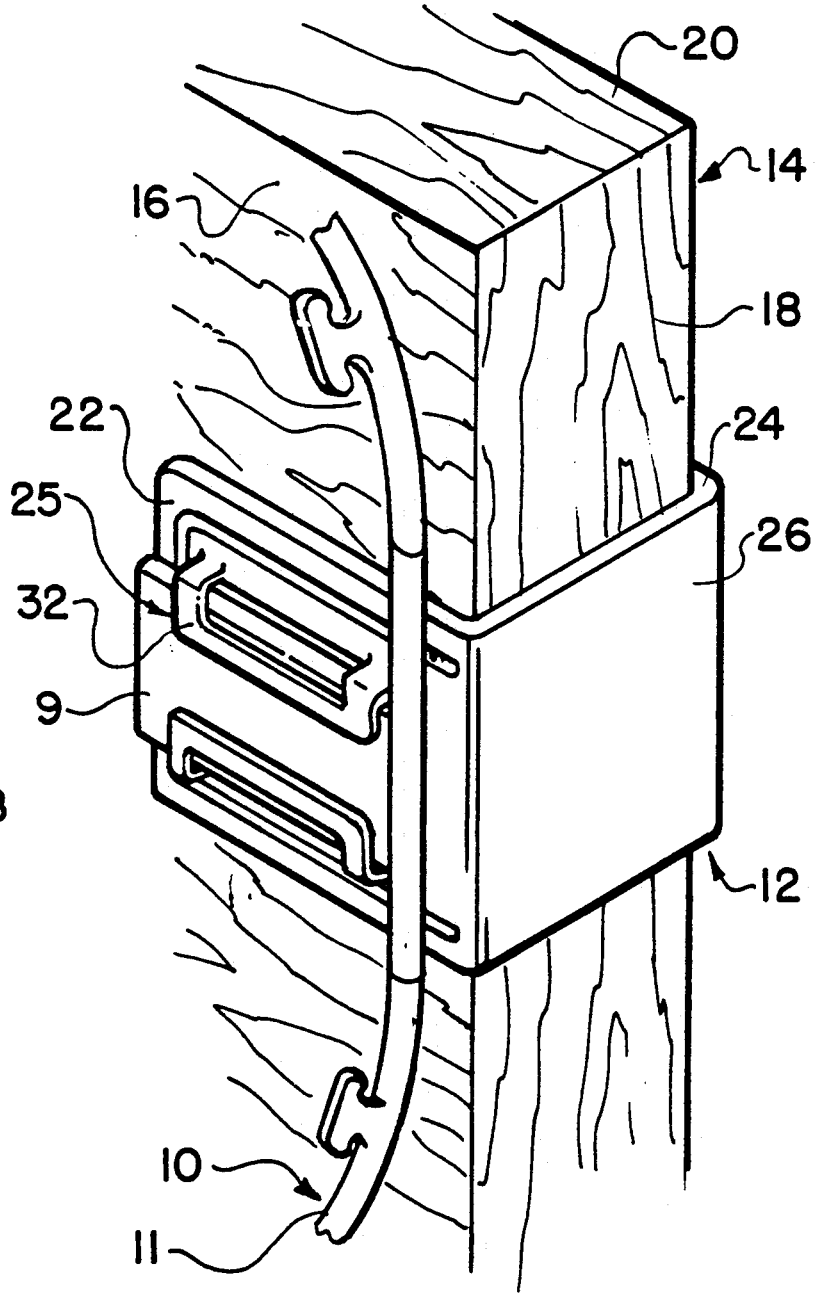
FIG. 3B is a perspective view of the basketball hoop structure of FIG. 1, showing the bracket mounted to a door along a vertical side edge thereof and the hoop member supported vertically by the bracket.

The bracket 12 is thus capable of securely mounting the hoop member 10 to the door 14 either at its top edge 20, shown in FIG. 2, or at one of its side edges 18, shown in FIGS. 3A and 3B, for selective disposition of the hoop member 10 at a variety of heights above the floor. For example, as shown in FIG. 2, the bracket 12 has been fitted over the top of the door 14 such that the cross member 26 is in contact with the horizontal top surface 20 of the door and the door engaging surfaces of the leg members 22, 24 are each respectively in contact with one of the rectangular surfaces 16 of the door 14. In such disposition of the bracket 12, the first slideway is oriented substantially vertically so that the mounting portion 9 may be disposed in the first slideway under the tabs 32 to orient and securely hold the hoop portion 11 of the hoop member 10 to the door 14 in a substantially horizontal disposition the same as that of an actual basketball hoop, ready for a ball to be tossed therethrough.

Of course, the top edge 20 of the door 14 is at a uniform non-changeable height above the floor. If the user desires to adjust the height of the hoop member 10 above the floor to, for example, accommodate shorter players, the user can adjust the bracket 12 to secure the hoop member 10 at any one of an unlimited number of positions spaced above the floor by mounting the bracket 12 along one of the vertical side edges 18 of the door 14. As shown in FIG. 3A, the bracket 12 thusly mounted has its cross member 26 in contact with one of the side surfaces 18 of the door 14 (due to space constraints, it is generally preferable to position the bracket 12 against the side surface 18 which is remote from the door hinges) and its leg members 22, 24 in contact with the opposite rectangular surfaces 16 of the door 14. As discussed above, the leg members 22, 24 are biased toward one another such that the door 14 is sufficiently compressively gripped therebetween that the bracket 12 does not move either due to its own weight or the impact of an object thereagainst, such as a ball tossed toward the hoop portion 11. Additionally, undesired movement of the bracket 12 may be further prevented by closing the door whereby the leg member 24 is clamped and held between the outside rectangular surface 16 of the door 14 and the door jamb. In normal use, it is desirable to keep the door closed to avoid possible distracting and undesired swinging movement of the door. In the disposition of the bracket 12 in FIG. 3A, the second slideway is oriented substantially vertically so that the mounting portion 9 may be inserted through the openings 40 defining the second slideway until the hoop portion 11 of the hoop member 10 abuts the legs 36 of the uppermost tab 32. Thus, the hoop portion 11 of the hoop member 10 is also oriented and securely held substantially horizontally in this relative assembly of the hoop member 10 and the bracket 12. Thus, the tabs 32 define first and second slideways, oriented perpendicular to each other, for receiving the mounting portion 9 of the hoop member 10 inserted therein to allow the hoop portion 11 to be oriented at a generally horizontal disposition, whether the bracket is mounted on either a horizontal or a vertical surface. When the bracket 12 is mounted to a horizontal surface, such as the top surface 20 of the door 14, the first slideway defined by the spaced leg pairs receives the mounting portion 9. On the other hand, when the bracket 12 is mounted to a vertical surface, such as the side surface 18, the second slideway defined by the openings 40 of the legs 36 receive the mounting portion 9.

To vertically adjust the bracket 12 relative to the door 14, the user need only open the door and slide the bracket 12 toward or away from the floor, with the leg members 22, 24 continuing to compressively engage the door 14, or the user can completely disengage the bracket 12 from the door 14, move the bracket 12 to the next desired vertical location and then press the bracket 12 onto the door so that the leg members 22, 24 again compressively engage the door and reclose the door. If desired, the user can easily remove the hoop member 10 while vertically adjusting the bracket 12 by lifting the hoop member 10 to withdraw the mounting portion 9 from the openings 40. Once the bracket 12 has again engaged the door at the new location and the door is closed, the mounting portion 9 can be reinserted through the openings 40 to again couple the hoop member 10 to the bracket 12.

As can be understood, when the bracket 12 is mounted on either the top edge 20 or the side surface 18 of the door 14, the mounting portion 9 can be alternatively inserted in either the first slideway 33 or the second slideway 41. Thus, if the bracket 12 is mounted on the top edge 20 of the door 14, the mounting portion 9 can be inserted into the first slideway 33, as shown in FIG. 2, or can, alternatively, be inserted through the second slideway 41 to orient the hoop portion 11 at a generally vertical orientation for use in the playing of basketball-type games. Likewise, if the bracket 12 is mounted to the side surface 18 of the door 20, the mounting portion 9 can be inserted through the second slideway 41 as shown in FIG. 3A or can, alternatively, be inserted through the first slideway 33 to orient the hoop portion 11 at a generally vertical orientation for use, as shown in FIG. 3B, in the playing of basketball-type games such as, for example, a game wherein the object is to bank a ball off a vertical wall through the hoop portion 11.

Figure 4:
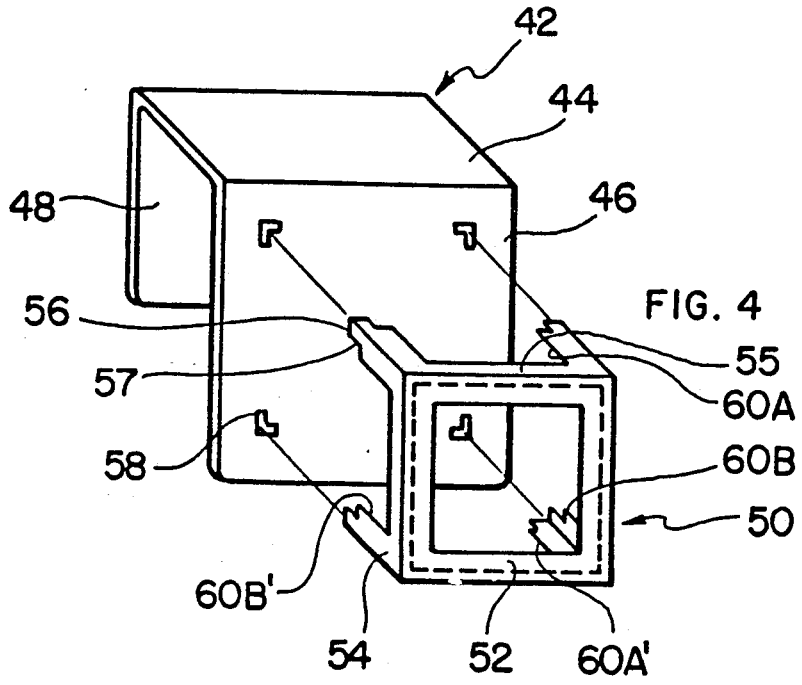
FIG. 4 is a perspective view of another embodiment of the basketball hoop structure of the present invention.

As will be readily understood, the hoop member 10 can be secured to the door 14 or another structure by bracket configurations other than those illustrated in FIGS. 1, 2, 3A and 3B. By way of example and without limitation, two other possible embodiments of the basketball hoop structure of the present invention are shown in FIGS. 4–7. In FIG. 4, an alternate form of bracket 42 is shown which includes a cross member 44 interconnecting leg members 46, 48 in spaced facing relation biased toward one other. In a manner similar to the construction of the bracket 12 discussed above, the bracket 42 is thus adapted to be fixedly secured to a structure such as the door 14 by positioning thereover with the leg members 46, 48 engaging opposed surfaces of the structure to compressively grip the structure.

The bracket 42 also includes a hoop coupling member 50 for selective coupling of the hoop member 10 to the bracket 42. The hoop coupling member 50 includes a generally square retaining portion 52 from the corners of which four legs 54 project generally perpendicularly. Each adjacent pair of legs 54 is interconnected by a reinforcing bar 55 connected at its ends to one leg 54 and connected along its length to the retaining portion 52. Each leg 54 has a generally right angled cross section and a free end portion 56 of reduced dimension forming a shoulder 57. The leg member 46 of the bracket 42 includes four right-angled keyways 58 specifically located and configured to receive the free end portions 56 of the legs 54 to thereby secure the hoop coupling member 50 thereto. As can be understood, the free end portions 56 are inserted into the keyways 58 until the shoulders 57 abut the leg member 46. With the free end portions received in the keyways 58, the retaining portion 52 is in spaced, parallel relation with the leg member 46. The hoop coupling member 50 may be permanently secured to the leg member 46 by, for example, crimping of the free end portions 56 inserted through the keyways 58 or by adhesive or bonding means applied between the leg member 46 and the free end portions 56. Alternatively, the free end portions 56 of the legs 54 may be formed with detents or other suitable means enabling the hoop coupling member 50 to be snap-fitted into and out of assembly with the leg member 46.

When the bracket 42 is so assembled, each pair of adjacent legs 54 together with the leg member 46 and the reinforcing bars 55 define therebetween an opening 60, the openings being respectively designated 60A, 60A', 60B, and 60B' and being of essentially the same generally rectangular configuration. The openings 60A and 60A' are aligned to define a first slideway, and the openings 60B and 60B' are aligned to define a second slideway essentially perpendicular to the first slideway, each slideway being adapted for selectively receiving the mounting portion 9 of the hoop member 10 therein, in a manner described below, to thereby couple the hoop member 10 to the hoop coupling member 50.

In use, the bracket 42 is selectively inserted over the support structure, such as the door 14, such that its leg members 46, 48 compressively engage the door therebetween. If the bracket 42 is inserted on the top of the door 14, that is, with its cross member 44 in contact with the top surface 20 of the door, the hoop member 10 can be selectively coupled to the bracket 42 by inserting its mounting portion 9 through the first slideway defined by the pair of openings 60A and 60A' of the hoop coupling member 50. As can be understood, the mounting portion 9 is prevented from movement in various directions by the pairs of legs 54 which define the openings 60A and 60A', their respective reinforcing bars 55 and the leg portion 46. With the mounting portion 9 received in the first slideway, the hoop portion 11 is oriented generally horizontally at a suitable disposition for tossing a ball therethrough.

Alternatively, if the user desires to dispose the hoop member 10 at a vertical spacing from the floor different than the vertical spacing obtained when the bracket 42 is mounted on the top surface 20 of the door 14, the user can dispose the bracket 42 at any one of an unlimited number of positions along the side of the door 14. Specifically, the user need only position the bracket 42 along the side surface 18 remote from the side surface at which the door is hinged, compressively engage the door 14 between the leg members 46, 48, and then selectively insert the mounting portion 9 through the second slideway defined by the openings 60B and 60B'.

Figure 5:
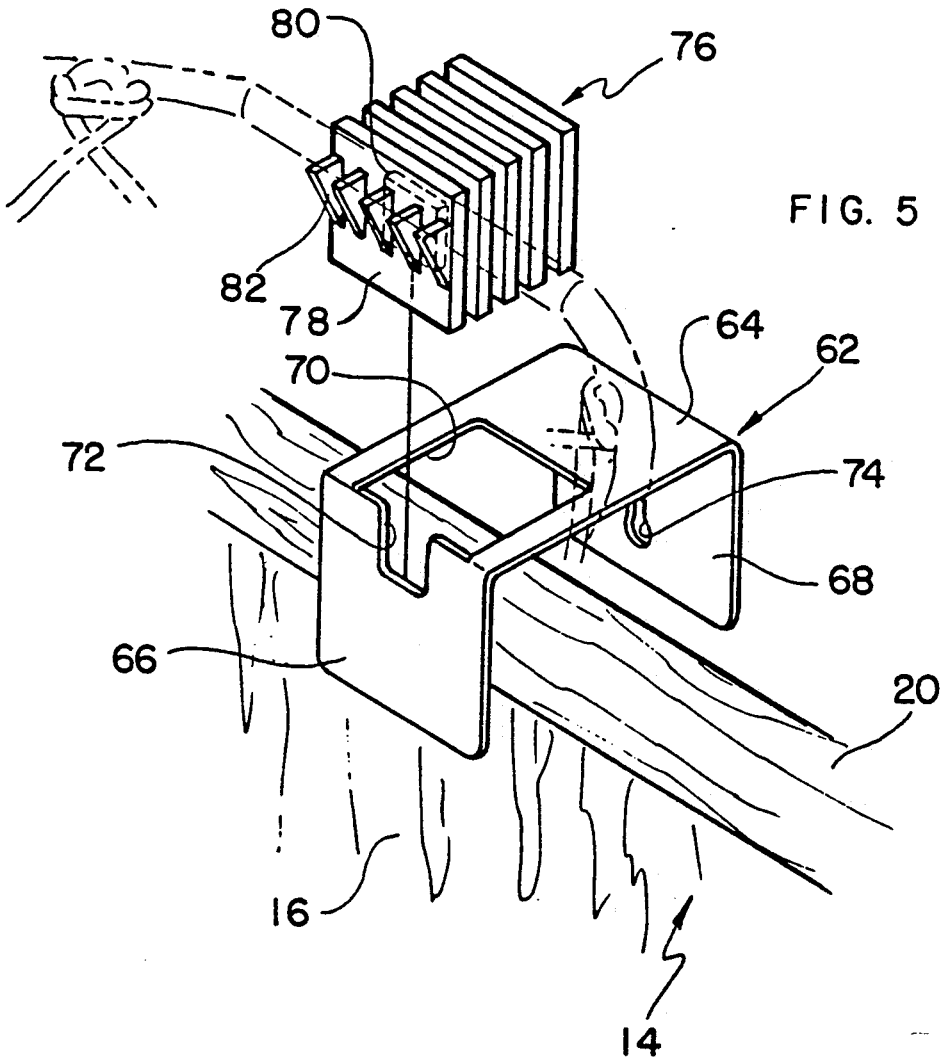
FIG. 5 is a perspective view of a further embodiment of the basketball hoop structure of the present invention.
Figure 6A:
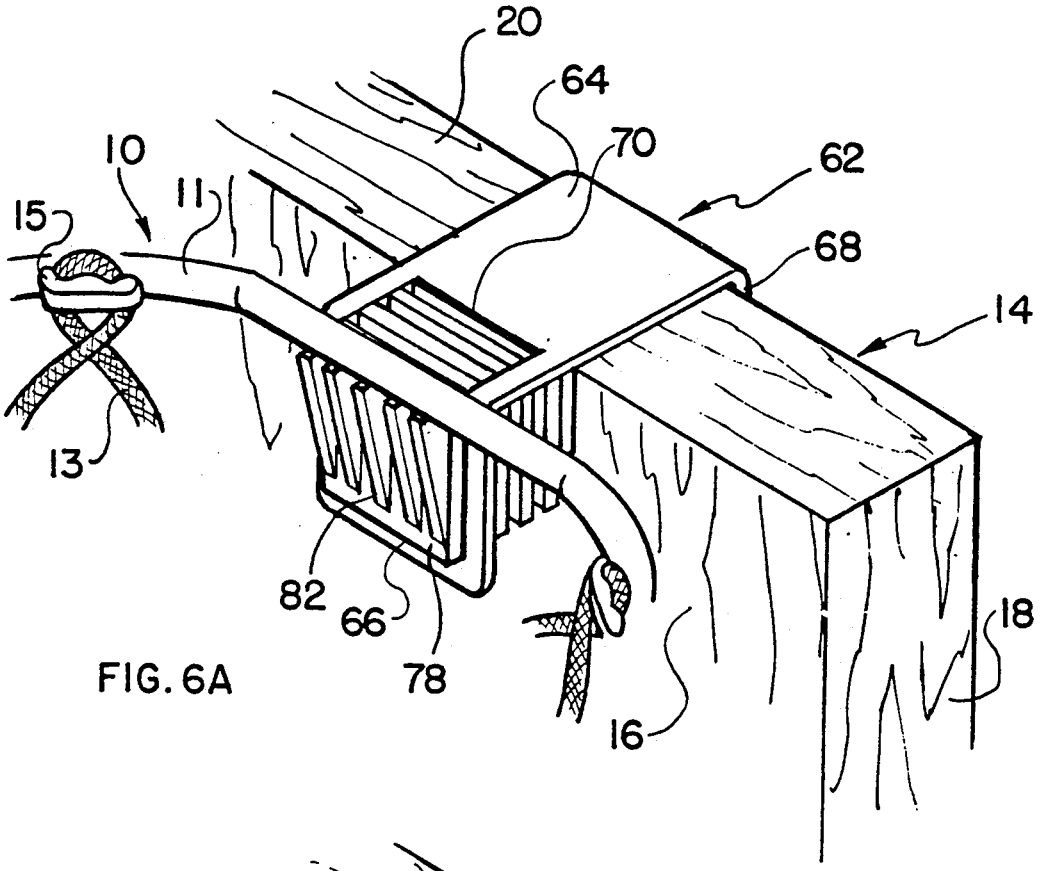
FIG. 6A is a perspective view of the basketball hoop structure of FIG. 5, showing the bracket mounted on a top horizontal edge of a door.
Figure 6B:
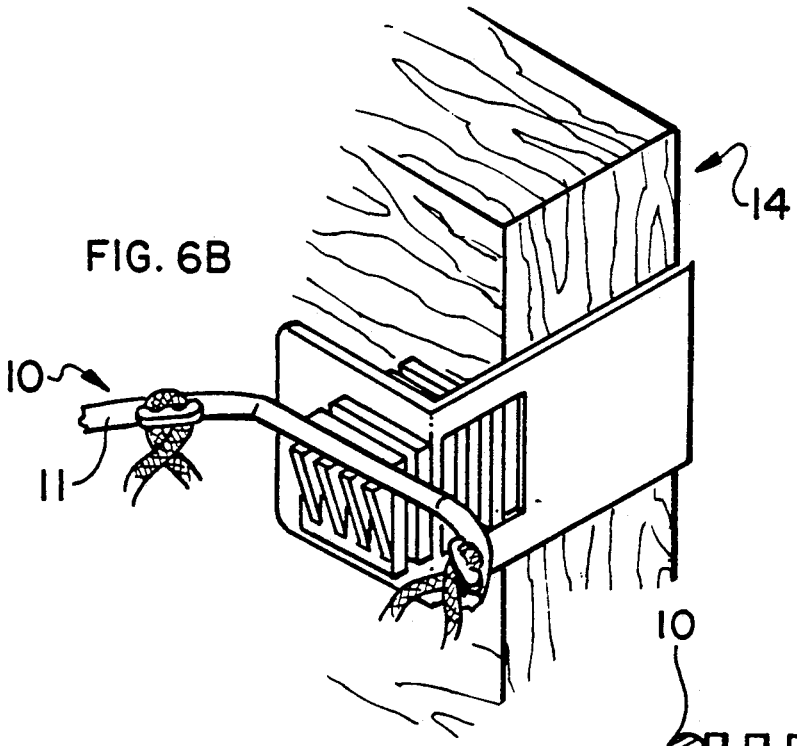
FIG. 6B is a perspective view of the basketball hoop structure of FIG. 5, showing the bracket mounted along a vertical side edge of a door.
Figure 7:
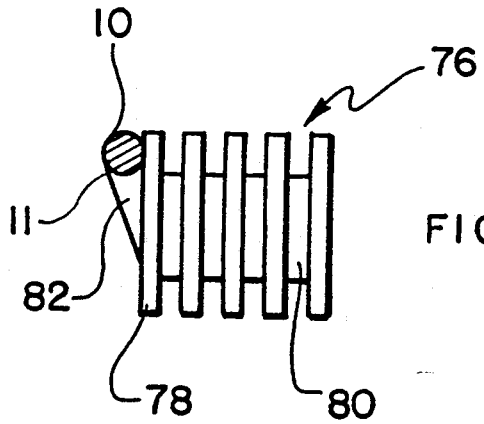
FIG. 7 is a side elevational view of the hoop member mounting portion of the basketball hoop structure of FIGS. 6A and 6B.

In FIGS. 5–7, a third embodiment of the basketball hoop structure of the present invention is illustrated. A bracket 62 includes a cross member 64 which interconnects leg members 66, 68, which project in spaced facing relation generally perpendicularly from the cross member 64. The cross member 64 is formed with a generally rectangular opening 70 and the leg member 66 includes a generally rectangular opening 72, the openings 70, 72 communicating with one another along the juncture between the leg member 66 and cross member 64 such that the openings together form a single, continuous opening which functions as a slideway for supporting the hoop member 10 in a selectively generally horizontal position when the bracket 62 is selectively mounted to one of the vertical side surfaces 18 or the horizontal top surface 20 of the door 14. The leg member 68 includes a pair of keyways 74 for receiving bolts or screws (not shown) therethrough to fixedly secure the bracket 62 to the door 14 or another building surface such as a vertical wall.

In the basketball hoop structure of FIG. 5, the hoop member includes an alternate form of hoop mounting portion 76 configured to cooperate with the bracket 62 to secure the hoop member 10 to the bracket 62 in a manner which permits the accommodation of a range of support structures having varying thicknesses, e.g. doors of differing thickness. For this reason, the spacing between the leg members 66, 68 is selected to be slightly greater than the thickest anticipated support structure within the range of doors and other possible support structures from which the bracket 62 can be supported.

As best seen in FIG. 7, the hoop coupling member 76 includes a plurality of relatively larger plates 78 and a plurality of relatively smaller plates 80. In the preferred embodiment illustrated in FIGS. 5–7, the larger plates 78 and the smaller plates 80 are of generally square configuration although the present invention contemplates that the plates can be of any other appropriate symmetrical shape such as, for example, circular shape. The larger plates 78 are arranged in alignment with one another and each pair of larger plates 78 is interconnected by an intervening one of the smaller plates 80 which are themselves arranged in alignment with one another and symmetrically with the larger plates 78. The frontmost larger plate 78 has a plurality of spaced, aligned support arms 82, on top of which the hoop portion 11 is affixed permanently by suitable means such as, for example, adhesion to the tops of the support arms 82 and to the frontmost large plate 78 or by integral molding of the entire coupling member. The spacing between each adjacent pair of the larger plates 78 is about the same as or slightly greater than the widthwise extent of the leg member 66, for a reason which is explained below. Additionally, the edgewise extent of the larger plates 78 is about the same as or slightly less than the widthwise extent of the opening 70. The smaller plates 80 have an edgewise extent slightly less than the lateral extent of the opening 72, as shown in FIG. 5.

FIGS. 5, 6A and 6B illustrate two steps in the procedure for cooperatively assembling the hoop mounting member 76 and the bracket 62 to simultaneously mount the hoop member 10 to the bracket 62 and to mount such assembly on the door 14 by compressive engagement of the door 14 between the hoop mounting member 76 and the bracket 62. Specifically, the bracket 62 is initially placed over the door 14 such that the cross member 64 is in contact with the top surface 20 of the door 14 (or, alternatively, one side surface 18) and the leg member portion 68 is in contact with one of the rectangular surfaces 16 of the door 14. Since the spacing between the leg members 66, 68 is greater than the thickness of the door 14, the leg member 66 is not in contact with the other rectangular surface 16 of the door 14 but is, instead, in spaced, parallel relationship therewith. Thereafter, the hoop mounting member 76 is aligned for engagement with the bracket 62 by positioning it relative to the bracket such that its larger plates 78 are aligned with the opening 70 and its smaller plates 80 are aligned with the recess 72. Then, in correspondence with the extent of the spacing between the leg member 66 and the other rectangular surface 16 of the door 14, the hoop mounting member 76 is moved into engagement with the bracket 62 such that a selected one of the smaller plates 80 is received within the opening 72 and the pair of larger plates 78 adjacent the selected small plate 80 move into bracketing relationship with the leg member 66. The opening 72 is dimensioned with respect to the smaller plates to such that the smaller plate 80 received therein can be inserted to a depth which ensures that the tops of the larger plates 78 will clear the door jamb when the door 14 is closed. That is, the tops of the larger plates 78 must be substantially at the same height as the top surface of the cross member 64 to ensure that the door 14 can close within its door jambs. As can be understood, one of the pair of the adjacent larger plates 78, as well as the larger plates therefollowing, are received in the opening 70 as the hoop mounting member 76 is moved into engagement with the bracket 62. The rearmost of the larger plates 78 is brought into face abutting engagement with the rectangular surface 16 of the door 14 during this movement.

Thus, as best seen in FIG. 6A, the hoop member 10 is secured to the door 14 by the cooperation of the hoop mounting member 76 and the bracket 62. The rearmost larger plate 78 of the hoop mounting member 76 cooperates with the leg member 68 of the bracket 62 to compressively engage the door 14 therebetween. The rearmost larger plate 78 is maintained in contact with the associated rectangular surface 16 of the door 14 by the action of the pair of large plates adjacent the selected smaller plate 80 received within the opening 72. Specifically, depending upon the relative dimensions of the door 14 being engaged, one of the pair of adjacent large plates 78 will be in pressing contact with the leg member 66.

To accommodate other doors having varying thicknesses, the user need only select the appropriate smaller plate 80 to be received within the opening 72, thereby determining the extent to which the rearmost larger plate 78 will be spaced from the leg member 66 towards the door 14, it being desired, of course, to insert the respective smaller plate 80 which will insure that the rearmost larger plate 78 contacts the associated rectangular surface 16 of the door 14 such that the door is compressively engaged between that plate and the leg member 68.

As shown in FIGS. 5, 6A and 6B, the bracket 62 can be disposed along the side of the door 14 in a similar manner to its disposition on the top of the door. The user selects the appropriate smaller plate 80 to be received in the opening 72 to insure compressive engagement of the door between the rearmost larger plate 78 and the leg member 68. As can be understood, the orientation of the hoop mounting member 76 relative to the bracket 62 is adjusted as necessary so that the hoop portion 11 is generally parallel to the floor. Thus, as seen in FIG. 6B, in positioning the hoop mounting member 76 to the bracket 62 when the bracket is disposed along the side edge 18 of the door 14, the orientation of the hoop coupling member 76 to the bracket 62 is changed by 90° as compared to the orientation of these two members in their assembly together shown in FIG. 6A for supporting the hoop member 10 from the top edge 20 of the door 14.

Although each embodiment of the bracket of the present invention has been described with respect to the means thereon for compressively engaging the door 14, it is also possible to exclusively secure the bracket to the door, a vertical building wall or another building structural member by means of screws inserted through the keyways 30 (in the embodiment of FIG. 1) or 74 (in the embodiment in FIG. 5) of the bracket, whereupon the bracket need not compressively engage the door or other structure to be mounted thereon.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A selectively mountable hoop structure for use in playing basketball-type games, comprising:

a hoop member defining an opening adapted for passage therethrough of a ball, said hoop member including a mounting portion; and a bracket for selective mounting of said hoop member, said bracket being of a generally U-shape for selective alternative receipt of an exposed edge of a building door and like structural members of buildings, said bracket having means compatible with said mounting portion of said hoop member for receiving said mounting portion selectively in alternative first and second orientations relative to said bracket for selectively altering the relative verticality and horizontality of said hoop member, said mounting portion receiving means including a pair of spaced tabs projecting from said bracket and defining therebetween a first slideway for insertion of said mounting portion of said hoop member in said first orientation, said tabs having respectively aligned openings therethrough defining a second slideway for insertion of said mounting portion of said hoop member in said second orientation.

2. A selectively mountable hoop structure for use in playing basketball-type games according to claim 1 and characterized further in that said first and second slideways are oriented generally perpendicularly to one another.

3. A selectively mountable hoop structure for use in playing basketball-type games according to claim 1 and characterized further in that said bracket includes an opening for receipt of a fastener therethrough for fastening to the structural building member.

4. A selectively mountable hoop structure for use in playing basketball-type games according to claim 1 and characterized further in that said bracket comprises first and second leg members in spaced facing relation and a cross member extending transversely therebetween, said leg members being biased toward one another for resiliently gripping the structural building member to retain said bracket thereon.

5. A selectively mountable hoop structure for use in playing basketball-type games according to claim 1 and characterized further in that said hoop member includes means for supporting a net on said hoop member.

6. A selectively mountable hoop structure for use in playing basketball-type games, comprising:

a hoop member defining an opening adapted for passage therethrough of a ball, said hoop member including a mounting portion; and a bracket for selective mounting of said hoop member, said bracket being of a generally U-shape for selective alternative receipt of an exposed edge of a building door and like structural members of buildings, said bracket having means compatible with said mounting portion of said hoop member for receiving said mounting portion selectively in alternative first and second orientations relative to said bracket for selectively altering the relative verticality and horizontality of said hoop member, said mounting portion receiving means includes a selectively detachable coupling portion defining a first pair of aligned openings defining a first slideway for insertion of said mounting portion of said hoop member in said first orientation and a second pair of aligned openings defining a second slideway for insertion of said mounting portion of said hoop member in said second orientation.

7. A selectively mountable hoop structure for use in playing basketball-type games according to claim 6 and characterized further in that said first and second slideways are oriented generally perpendicularly to one another.

8. A selectively mountable hoop structure for use in playing basketball-type games according to claim 6 and characterized further in that said bracket comprises first and second leg members in spaced facing relation and a cross member extending transversely therebetween, said leg members being biased toward one another for resiliently gripping the structural building member to retain said bracket thereon.

9. A selectively mountable hoop structure for use in playing basketball-type games according to claim 6 and characterized further in that said hoop member includes means for supporting a net on said hoop member.

10. A selectively mountable hoop structure for use in playing basketball-type games, comprising:

a hoop member defining an opening adapted for passage therethrough of a ball, said hoop member including a mounting portion; and a bracket for selective mounting of said hoop member, said bracket being of a generally U-shape for selective alternative receipt of an exposed edge of a building door and like structural members of buildings, said bracket having means compatible with said mounting portion of said hoop member for receiving said mounting portion selectively in alternative first and second orientations relative to said bracket for selectively altering the relative verticality and horizontality of said hoop member;

said mounting portion receiving means defining a slideway for insertion of said mounting portion of said hoop member, said mounting portion being of a symmetrical configuration for selective alternative insertion in said slideway in said first and second orientations.

11. A selectively mountable hoop structure for use in playing basketball-type games according to claim 10 and characterized further in that said mounting portion includes a plurality of spaced mounting elements for alternative insertion in said slideway for varying the relative disposition of said hoop member toward and away from the structural building member.

12. A selectively mountable hoop structure for use in playing basketball-type games according to claim 11 and characterized further in that said mounting portion receiving means supports said mounting portion of said hoop member in facing relationship with the structural building member, said mounting elements permitting selective disposition of said mounting portion in surface abutment with the structural building member for frictionally retaining said bracket and hoop member thereon.

13. A selectively mountable hoop structure for use in playing basketball-type games according to claim 10 and characterized further in that said hoop member includes means for supporting a net on said hoop member.

* * * * *